United States Patent [19]

Thierry

[11] 4,228,586

[45] Oct. 21, 1980

[54] SHAVING APPARATUS

[76] Inventor: Timothy T. Thierry, 1116 N. 31st St., Billings, Mont. 59101

[21] Appl. No.: 14,370

[22] Filed: Feb. 23, 1979

[51] Int. Cl.[3] ..... B26B 21/40

[52] U.S. Cl. ..... 30/41

[58] Field of Search ..... 30/41, 41.5

[56] References Cited

U.S. PATENT DOCUMENTS

| | | | |
|---|---|---|---|
| 2,336,806 | 12/1943 | Schenk | 30/41.5 |
| 4,077,119 | 3/1978 | Sellera | 30/41 |
| 4,177,556 | 12/1979 | Galli | 30/41 |

FOREIGN PATENT DOCUMENTS

| | | | |
|---|---|---|---|
| 2514174 | 10/1976 | Fed. Rep. of Germany | 30/41 |
| 490808 | 8/1938 | United Kingdom | 30/41 |
| 597918 | 2/1948 | United Kingdom | 30/41 |

*Primary Examiner*—Jimmy C. Peters
*Attorney, Agent, or Firm*—Arthur L. Urban

[57] ABSTRACT

Shaving apparatus including a shaver head portion, a handle portion and a liquid conveying portion, the shaver head portion including a substantially planer face, at least one razor blade disposed adjacent to the face with the sharpened edge thereof extending outwardly therefrom, an orifice in the shaver head face adjacent to the blade, a passage extending through the shaver head portion from the orifice, the handle portion including a conduit extending along the length thereof with one end communicating with the passage through the shaver head portion and the other end of the conduit within the handle portion which is remote from the shaver head portion being connected to one end of the liquid conveying means, the opposite end of the liquid conveying means being adapted for attachment to a source of water under pressure, and the handle portion including valve means for controlling the flow of water from the water source through the liquid conveying means, the conduit of the handle portion, the shaver head passage and out the orifice of the shaver head face.

10 Claims, 5 Drawing Figures

SHAVING APPARATUS

This invention relates to a novel shaving apparatus and more particularly relates to a new apparatus for shaving by hand.

Through the years, a wide variety of devices have been used to shave unwanted hair from the human body. Until recently, most attention has been directed toward removal of men's beards. However, in the last few years, products for the removal of hair from women's bodies have been widely promoted.

Shaving devices can be broadly classified into two groups, those that rely on hand movement exclusively to cut the hair and move the shaver over the face and those that employ a motor to accomplish the cutting of the hair while the hand moves the shaver into position. Although the advantages of using an electric shaver are widely advertised, a majority of men utilize manual shavers.

A large number of different shavers or razors are offered for sale in most drug stores. Each emphasizes its special features which are claimed to provide a better shave. For example, multiple blades rather than a single blade, adjustability of the angle of the blade, low cost, and the like are touted. In addition, a wide range of products are advertised for use with the razors to facilitate obtaining a close shave. Special shaving creams, gels, foams, etc. are offered as well as preshave and after-shave preparations.

A typical beard shaving routine generally includes washing the face with hot water to soften the beard and remove oils from the skin. Then, while the face is still wet, a shaving cream or the like is applied to the face. A lather is developed and allowed to remain on the skin for a short period of time before starting the actual shaving operation.

Generally, the shaving head of the razor is dipped into hot water a number of times during the shaving, usually after every few strokes of the razor. This is done to wash the accumulated lather and whiskers from the blade and at the same time to apply a fresh film of water to the blade to provide lubrication during subsequent stroking of the razor over the face. Finally, the razor is rinsed with clean hot water after the face has been shaved before storage. Although individuals may argue the merits of variations in the above procedure, these steps are followed in whole or in part by most men.

Regardless of the type of razor or other products used, the objective still is to obtain a close shave with a minimum of skin irritation in the shortest period of time. Time is important since shaving ordinarily is done in the morning when a person is in a rush to shower, dress, eat and do his other tasks before leaving for work. Saving even a few minutes in shaving can allow more time for other more pleasant things such as time for a second cup of coffee and a glance at the morning newspaper.

If a person tries to rush the steps he follows in shaving, he generally will get a shave which is not as close as he desires or he may increase the irritation of his skin even to the point of cutting himself. Thus, to obtain satisfactory results, an individual must shave at a comfortable pace and instead hurry through other parts of his morning routine. Although a few shaving products advertise that shaving time can be shortened, most emphasize the closeness of their shave and the reduction in skin irritation.

The present invention provides a novel shaving apparatus which facilitates obtaining a superior shave. The shaving apparatus of the invention assists in obtaining an especially close shave with reduced skin irritation. Also, the shaving apparatus enables the shaving to be completed in a shorter period of time by simplifying the normal shaving procedure. Furthermore, the shaving apparatus makes shaving more convenient.

The shaving apparatus of the present invention is simple in design and can be manufactured in quantity relatively inexpensively. The shaving apparatus can be manufactured from commercially available materials using known fabricating techniques and equipment.

Other benefits and advantages of the novel shaving apparatus of the invention will be apparent from the following description and the accompanying drawings in which.

Figure 1:
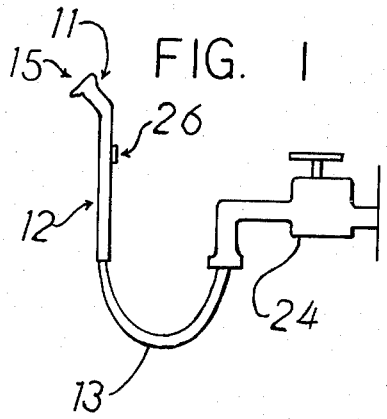
FIG. 1 is a view in perspective of one form of the novel shaving apparatus of the invention.
Figure 2:
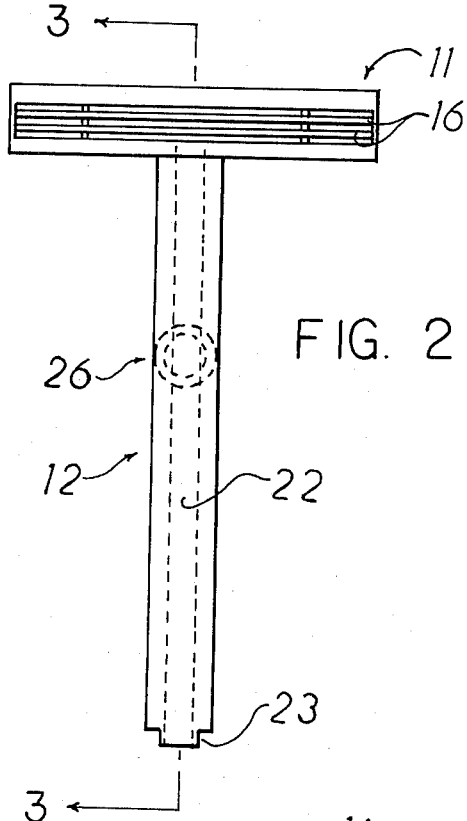
FIG. 2 is an enlarged side view of the shaving apparatus shown in FIG. 1.
Figure 3:
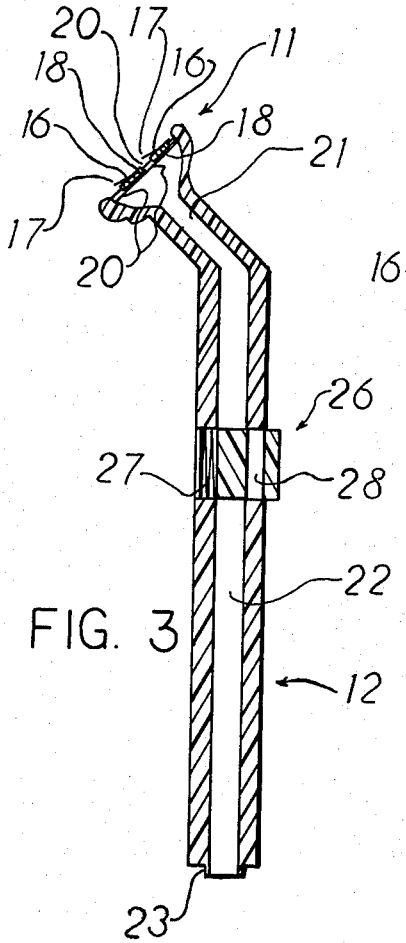
FIG. 3 is a sectional view of the shaving apparatus shown in FIGS. 1 and 2 taken along line 3—3 of FIG. 2.
Figure 4:
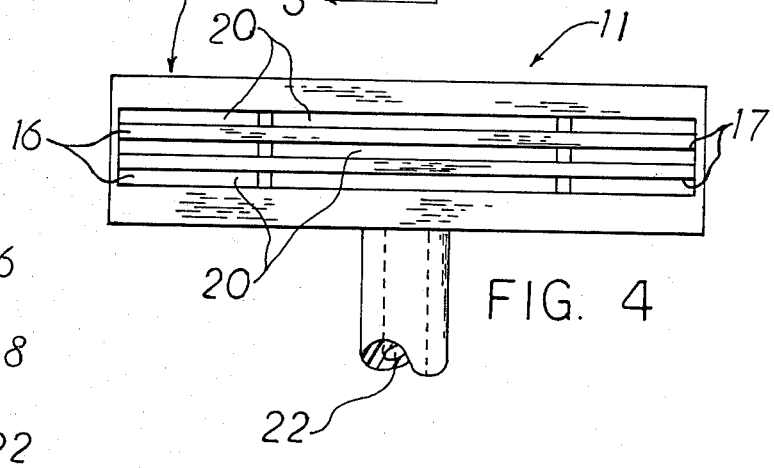
FIG. 4 is a further enlarged view of the face of the shaving head portion of the shaving apparatus.

As shown in the drawings, one form of the novel shaving apparatus of the present invention includes a shaver head portion 11, a handle portion 12 and a liquid conveying portion 13. Advantageously, the shaver head portion 11 and the handle portion 12 are formed as a unitary structure, preferably by molding of a plastic material. The shaver head portion 11 as shown preferably is disposed at an angle to the longitudinal axis of handle portion 12.

Shaver head portion 11 includes a substantially planer face 15 with at least one blade 16 and preferably with a plurality of blades, disposed adjacent to the face with the sharpened edge 17 thereof extending outwardly therefrom. Blade-holding means shown as slots 18 disposed in the shaver head portion 11 adjacent face 15 maintain the blade or blades 16 in proper alignment with the face, advantageously in substantially parallel orientation.

An orifice 20 is located in the face 15 of the shaver head portion 11 adjacent to blades 16. A passage 21 extends through the shaver head portion 11 from the orifice 20 to the side of the shaver head portion remote from the face 15.

Handle portion 12 includes a conduit 22 extending along the length thereof with one end communicating with the passage 21. The other end 23 of conduit 22 within handle portion 12 which is remote from shaver head portion 11 is connected to one end of liquid conveying means 13. Advantageously, liquid conveying means 13 is a flexible hose as shown. The opposite end of the liquid conveying hose or tubing is adapted for attachment to a source of water, e.g. faucet 24.

Handle portion 12 includes valve means for controlling the flow of water from the water source 24 through the liquid conveying means 13, the conduit 22 of handle portion 12, the passage 21 of shaver head portion 11 and out the orifice 20 of the shaver head face 15. Preferably, as shown the valve means includes a hollow cylindrical section 26 disposed in an opening along the length of handle portion 12. Valve section 26 is biased transversely of the longitudinal axis of handle portion 12 by a spring 27 to effect a closing of conduit 22 therethrough. Valve section 26 has a passage 28 therein which is substantially parallel to conduit 22 of the handle portion 12. The application of pressure on valve section 26 against spring 27 aligns passage 28 thereof with conduit 22 to provide a through path from one end of handle portion 12 to the other.

Figure 5:
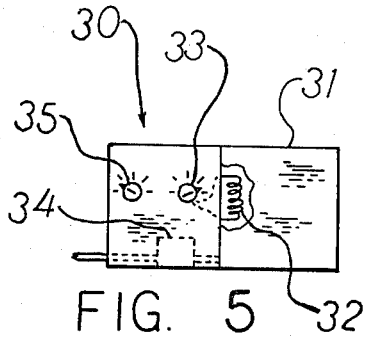
FIG. 5 is a schematic illustration of another form of the water source portion of the shaving apparatus.

The water source may comprise a water storage apparatus 30 as shown in FIG. 5. Apparatus 30 may include a water chamber 31 with an electrical coil 32 disposed therein for heating the water stored therein. Suitable controls 33 may be included to regulate the temperature of the water. Also, the apparatus 30 may include flow control means such as pump 34 to increase the pressure of the water conveyed through the shaving apparatus to the shaver head face. Suitable controls 35 provide for the flow of water to be regulated to the desired pressure.

In the use of the shaving apparatus of the present invention as shown in FIGS. 1–4 of the drawings, one or more blades 16 are inserted into slots 18 of shaver head portion 11 adjacent to face 15. The adapter end of liquid conveying tubing 13 is attached to faucet 24 and the faucet handle turned on.

The shaving apparatus is now ready for use. After a lather has been applied to the face, the handle portion 12 is grasped as a conventional razor handle would be and the shaver head face 15 placed next to the skin of the individual with the sharpened edges of blades 16 in contact therewith. The exposed portion of valve section 26 is pressed into the handle portion 12 against the resisting force of spring 27. This action brings passage 28 of the cylindrical section 26 into alignment with conduit 22 so that water may pass through conduit 22 and passage 21 of the shaver head portion 11 to the shaving face 15. In this way, the person shaving does not have to interrupt his stroking of the blades to dip the shaver into water. As a result, the individual can more closely control the amount of water in contact with his blades and with his face. Thus, a closer shave can be obtained with a minimum of irritation in a shorter period of time.

In the use of the water storage apparatus 30 shown in FIG. 5, water can be added to chamber 31 and controls 33 adjusted to provide the desired temperature water by the heating action of electrical coil 32. Also, controls 35 are adjusted to provide the desired pressure to the water being delivered from chamber 31 through activation of pump 34. In this way, very close control of the water passing through the shaving apparatus of the invention can be achieved to provide the optimum in shaving results for each individual user.

The above description and the accompanying drawings show that the present invention provides a novel shaving apparatus which assists in obtaining an especially close shave with a minimum of skin irritation. Furthermore, the shaving apparatus of the invention provides this close, comfortable shave by a simplified procedure so that the shaving can be completed in a shorter period of time. Not only is shaving quicker with the shaving apparatus of the invention, but also the shaving can be accomplished more conveniently.

The shaving apparatus of the present invention, in addition, is simple in design. The shaving apparatus can be fabricated relatively inexpensively from commercially available materials. Moreover, the fabrication of the shaving apparatus can be accomplished utilizing industrially employed manufacturing techniques.

It will be apparent that various modifications can be made in the particular shaving apparatus described in detail above and shown in the drawings within the scope of the invention. For example, the shaving apparatus can be fabricated from one or more of a variety of materials such as plastic, metal and the like. Also, the size and configuration of the particular portions can be changed to meet specific requirements. Further, other accessories in addition to the water storage apparatus can be included as desired. Therefore, the scope of the invention is to be limited only by the following claims.

What is claimed is:

1. Shaving apparatus including a shaver head portion, a handle portion and a liquid conveying portion, said shaver head portion including a substantially planer face, an orifice in said shaver head face, at least one razor blade disposed adjacent to said face central of said orifice with the sharpened edge thereof extending outwardly therefrom, said orifice being significantly larger than the width of said blade to provide open areas on both sides of said blade, a passage extending through said shaver head portion from said orifice, said handle portion including a conduit extending along the length thereof with one end communicating with said passage through said shaver head portion and the other end of said conduit within said handle portion which is remote from said shaver head portion being connected to one end of said liquid conveying portion, the opposite end of said liquid conveying portion being adapted for attachment to a source of water under pressure, and said handle portion including valve means for controlling the flow of water from said water source through said liquid conveying portion, said conduit of said handle portion, said shaver head passage and out said orifice of said shaver head face.

2. Shaving apparatus according to claim 1 wherein said shaver head portion and said handle portion are formed as a unitary structure.

3. Shaving apparatus according to claim 2 wherein said shaver head portion and said handle portion are molded of plastic material.

4. Shaving apparatus according to claim 1 wherein a plurality of spaced razor blades are disposed in a substantially parallel orientation central of said orifice of said face of said shaver head portion.

5. Shaving apparatus according to claim 1 wherein said valve means includes a hollow cylindrical section biased transversely of said handle portion.

6. Shaving apparatus according to claim 1 wherein said face of said shaver head portion is disposed at an angle to the longitudinal axis of said handle portion.

7. Shaving apparatus according to claim 1 wherein said liquid conveying portion includes a flexible hose.

8. Shaving apparatus according to claim 1 including a water storage apparatus.

9. Shaving apparatus according to claim 8 wherein said water storage apparatus includes heating means.

10. Shaving apparatus according to claim 8 wherein said water storage apparatus includes pressure increasing means.

* * * * *